United States Patent [19]

Thevis et al.

[11] Patent Number: 4,505,336

[45] Date of Patent: Mar. 19, 1985

[54] FIRE EXTINGUISHER AND LIQUID DISPENSING APPARATUS

[75] Inventors: Paul Thevis; Tilo Möller, both of Oberndorf, Fed. Rep. of Germany

[73] Assignee: Heckler & Koch GmbH, Oberndorf, Fed. Rep. of Germany

[21] Appl. No.: 470,705

[22] Filed: Feb. 28, 1983

Related U.S. Application Data

[63] Continuation-in-part of Ser. No. 186,300, Sep. 11, 1980, abandoned.

[30] Foreign Application Priority Data

Oct. 6, 1979 [DE] Fed. Rep. of Germany ..... 2940601

[51] Int. Cl.[3] ..... A62C 35/18

[52] U.S. Cl. ..... 169/85; 169/9; 239/526; 222/389

[58] Field of Search ..... 169/9, 76, 72, 73, 71, 169/78, 26, 27, 85, 88, 86, 30; 239/526, 583, 590.5; 222/389, 135, 129, 386, 80, 81

[56] References Cited

U.S. PATENT DOCUMENTS 1,481,026 1/1924 Robinson et al. ..... 169/78

3,870,147 3/1975 Orth ..... 222/129

*Primary Examiner*—Joseph J. Rolla

*Assistant Examiner*—Kenneth Noland

*Attorney, Agent, or Firm*—Murray Schaffer

[57] ABSTRACT

The invention relates to a fire extinguisher comprising a low-pressure tank (1) for the fire-inhibiting liquid (40) and a high-pressure tank (23) for spray propellant gas, situated in the low-pressure tank, where upon opening the high-pressure tank, the propellant expels the fire-inhibiting liquid, which is discharged through a nozzle (44). In order to permit fighting fires effectively from a greater distance than hitherto, in this fire extinguisher a pressure regulating valve (13) is arranged between the outlet of the spray propellant gas container (23) and the liquid reservoir of the low-pressure tank (1), which valve maintains the pressure of the propellant gas prevailing in the low-pressure tank after triggering and expelling fire-inhibiting liquid (40) through nozzle (44) at a preset level.

28 Claims, 5 Drawing Figures

FIRE EXTINGUISHER AND LIQUID DISPENSING APPARATUS

RELATED APPLICATION

This application is a continuation in part of application Ser. No. 186,300, filed Sept. 11, 1980 now abandoned.

BACKGROUND OF THE INVENTION

The invention relates to a fire extinguisher with a low-pressure tank for a fire-inhibiting liquid and a high-pressure tank for spray propellant gas situated in the low-pressure tank, where after opening the high-pressure tank the propellant expels the fire-inhibiting liquid, which is discharged through a nozzle.

Known fire extinguishers of the type employing liquid comprise a low-pressure tank filled with tetrachloromethane, equipped with a pressure tank filled with liquid carbon dioxide. When a valve is opened, gaseous carbon dioxide flows from the boiling carbon dioxide into the low-pressure tank and expels the liquid tetrachloromethane. In soda-acid fire extinguishers, employing water as the fire-inhibiting liquid, sodium bicarbonate is mixed into the fire-inhibiting water in the low-pressure tank. To activate the extinguisher, a small bottle of sulfuric acid is broken, the acid reacts with the sodium bicarbonate to produce a relatively large amount of carbon dioxide. The carbon dioxide ejects the fire-inhibiting water in a powerful jet out of a riser pipe.

Foam fire extinguishers are also known, which are designed as large, mobile fire extinguishers and not as portable ones like the fire extinguishers described above. In this units water mixed with a foaming agent is contained in a low-pressure tank and is expelled by way of a hose from a spray rod. Nitrogen contained in an additional high-pressure tank serves as the propellant. The foam is produced in and ejected from the apparatus by injecting the nitrogen.

A disadvantage of the known type of fire extinguisher employing tetrachloromethane is that its capacity is limited and that the gaseous tetrachloromethane can be blown away from the fire by wind. The soda-acid fire extinguisher using water also has a limited capacity and is ineffective and even dangerous for fighting electrical and solvent fires. Foam fire extinguishers, on the other hand, have the disadvantage that it is not practicable to design them as portable apparatus and that the distance between the fire and the point where the foam is ejected from a nozzle can amount only to a few meters, since the foam is of low specific gravity, making long casts impossible.

Foam fire-inhibiting agents have become available recently which are ejected as a liquid and produce an inhibiting foam only in contact with the fire. However, optimum use of these liquids cannot be made with the portable fire extinguishers used hitherto. The object of the present invention is to design a fire extinguisher of the aforementioned type so that it has a large fire-fighting capacity and permits fighting fires effectively from a greater distance than hitherto. The long storage life, readiness for use at all times, and reliability typical of conventional hand fire extinguishers are also to be preserved.

SUMMARY OF THE PRESENT INVENTION

This problem is solved according to the invention by arranging a pressure regulating valve between the outlet of the spray propellant tank and the liquid reservoir of the low-pressure tank, which valve maintains the pressure of the propellant gas prevailing in the low-pressure tank after triggering, and which expels the fire-inhibiting liquid through the nozzle at a preset level.

In order to be able to fight a fire from a safe distance, whether because of the danger of explosion or of collapse of a building, or only because of the effects of the heat emitted by the fire, it is necessary to be able to spray the fire-inhibiting agent from a distance of at least 6 to 8, but preferably 10 to 20 meters. This has been possible neither with the portable fire extinguishers or hand fire extinguishers used hitherto, nor with the mobile foam fire extinguishers used hitherto, since the cast of the jet which could be achieved was only a few meters. Now it has been determined that, by maintaining the propelling pressure in the low-pressure tank at least approximately constant, and by appropriate choice of the design of the nozzle, a jet of liquid can be ejected over a distance of more than 10 to 20 meters, without the jet breaking up into individual droplets too much. The fire extinguisher in accordance with the invention is especially suitable for using the aforementioned liquid, which produces fire-inhibiting foam only in contact with fire. In order to achieve a long storage life, such as is known for the soda-acid fire extinguisher using water and sulfuric acid, a parent solution of the foaming agent is stored in the fire extinguisher separately from the actual fire-inhibiting liquid. A water-glycol mixture is preferred for use as the fire-inhibiting liquid. In a preferred embodiment of the invention, the parent solution is situated between the outlet of the pressure regulating valve and the transfer apertures for the propellant gas into the liquid reservoir of the low-pressure tank in such a manner that the parent solution can be mixed into the fire-inhibiting liquid by the reduced pressure of the propellant gas. Thus the propellant gas has more than one function in the fire extinguisher according to the invention, since it not only expels the fire-inhibiting liquid, but first, and, only after activation of the device, mixes the parent solution of foaming agent into the fire-inhibiting liquid.

For example, the arrangement can be such that the parent solution is contained in a rubber or plastic balloon or in a container which is not pressure-proof and which is subjected to such an excess pressure when the high-pressure tank for the propellant gas is opened that it bursts. However, this alone does not guarantee thorough mixing of the parent solution into the fire-inhibiting liquid. Therefore, in a preferred embodiment of the invention, the parent solution is contained in a cylinder whose end facing the pressure regulating valve is closed by a piston that can be moved by the reduced pressure of the propellant gas. When the propellant gas tank is opened, the reduced pressure of the propellant gas acts on this piston, which expels the parent solution through openings provided for the purpose. These openings may have been covered with a ruplurable membrane, which ruptures under sufficient pressure; or the arrangement can be such that the openings through which the parent solution is discharged are explosed only after the piston has moved. For this purpose, in a preferred further embodiment, the end facing away from the pressure regulating valve is also designed as a piston and is movable, and the discharge openings for the passage of the parent solution into the fire-inhibiting liquid are located in a section of the cylinder on the further side of this second piston. There is no difficulty in designing the openings so that they provide thorough mixing and turbulation upon passage of the parent solution into the fire-inhibiting liquid. This arrangement also has the advantage of very reliable performance, since it does not rely on rupturing diaphragms or the like. Instead indentical conditions are caused each time by the moving pistons. It is further advantageous in that, after use, such an apparatus can be refilled and re-used without difficulty.

The propellant gas tank and the pressure reducing valve can be arranged in verying fashions. For example, the propellant gas tank and the pressure reducing valve or pressure regulating valve might be fastened to the low-pressure tank. However, in a preferred embodiment of the invention, the propellant gas tank and the pressure reducing valve are located in line in a cylinder. This cylinder forms an extension of the cylinder containing the two pistons, and in particular, forms an integral part with said cylinder. Thus a compact assembly unit is obtained, which contains all the components essential to the functioning of the fire extinguisher. The fire extinguisher may be activated in various ways. For example, the propellant gas tank can be fitted with a screw-down valve. This screw-down valve can also be combined with the pressure reducing valve. However, such a screw-down valve has the disadvantage that, after the fire extinguisher has been stored for years, it may have become stiff. It may also have become leaky, so that the propellant gas may have escaped gradually without this being noticed, since the propellant gas which has emerged can escape through a safety overflow valve in the low-pressure tank.

In a preferred embodiment of the invention, the pressure reducing valve can slide along the cylinder and is accessible from the outside, with its end facing a break-off sealing nipple of the fixed propellant gas tank. The nipple can be broken off by a blow to the exterior portion of the pressure reducing valve. In this way, an arrangement is obtained which is not only compact, but also very reliable, and which can be made ready for use very quickly, namely by a blow to the exterior portion of the pressure reducing valve. Naturally, the exterior portion of the pressure reducing valve is secured against unintentional actuation by a seal, which can be removed quickly in an emergency.

In a preferred embodiment the cylinder can be screwed into the low-pressure tank as a complete unit. This makes it simple to remove the entire compact unit for refilling, maintenance or inspection. After removal of the cylinder, the low-pressure tank can be refilled with fire-inhibiting liquid extremely simply, as well.

The nozzle at the end of the hose (which could as well be mounted directly on the low-pressure tank, but this would make handling more difficult) is of streamlined shape and closes with a needle valve. The streamlined shape which is not impaired by the needle valve, which even in the open position does not disturb the flow too much, in conjunction with the preset pressure level allows the desired long cast to be achieved. In order to get as uniform a flow as possible, straightening vanes are arranged upstream of the nozzle. In additon, the transition from the straightening vane area to the nozzle is of hydrodynamically suitable design, with a gently tapered section followed in the direction of flow by a more steeply tapered section, which is smoothly formed into the throat section. The throat section, which is essentially cylindrical, merges without radius immediately upstream of the mouth into a short section of larger diameter. The needle of the needle valve rests, in the closed position, against the wall just upstream of the throat section.

In a preferred embodiment of the invention, the arrangement which comprises the nozzle, the needle valve, the straightening vanes, and the release mechanism is shaped like a pistol, with the release mechanism taking the form of a trigger. The hose is attached to the rear end of the pistol as an extension of the "barrel". The trigger takes the form of a lever, which is approximately parallel to and in front of the pistol grip. In a further preferred embodiment a second grip, essentially parallel to the pistol grip is provided at the front of the "barrel", which is advantageous in that the "pistol" can be held with both hands, and thus very securely, and the jet of fire-inhibiting agent can be directed.

The invention also relates to an apparatus for dispensing other liquids than those used in extinguishing fires. In such other apparatus a further fluid, preferably a concentrate, is added to a first liquid only immediately before the use of the apparatus. The first liquid is contained in a low pressure tank. The reason for adding the second liquid to the first at the last moment may be that the further fluid or concentrate may harm the reliable function of the apparatus if it is added to the first liquid some time before the use of the apparatus. Another reason may be that the further fluid is able to affect the well-being or health of people. If, for example, the low pressure tank contains a concentrate of tear gas mixed a long time before its use into the first liquid, then small leaks of the low pressure tank may cause injury for the user, such as the people of a police station where such apparatus are kept, particularly if small amount of the tear gas emerge unnoticed from the low pressure tank over a long period. Therefore, according to the invention, it is provided that the further fluid which has to be added to the first liquid contained in the low pressure tank is itself contained in a destroyable container which is destroyed on opening the high pressure tank containing the propellant gas, or which container for the further fluid is opened, whereby the further fluid is released and allowed to flow into the first liquid.

The term "further fluid" is used here because it may be that this further fluid is under atmospheric pressure normally in the form of a gas and only in the form of a liquid when contained in its container under a raised pressure.

BRIEF DESCRIPTION OF THE DRAWINGS

Further details and embodiments of the present invention will become apparent from the following description of an example shown in the drawing, in conjunction with the claims. The drawing shows simplified and diagrammatic representations, omitting details not necessary for understanding the invention, where:

DESCRIPTION OF THE INVENTION

Figure 1:
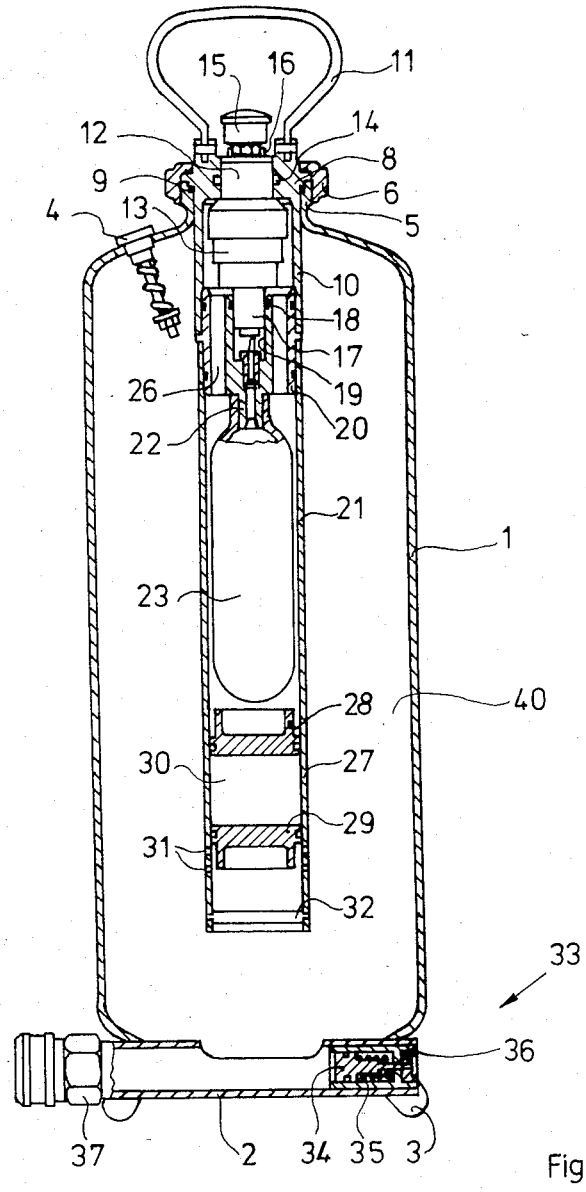
FIG. 1 is a longitudinal section through a fire extinguisher, the individual parts being in the inoperative position, FIG. 2 the arrangement in accordance with FIG. 1 after actuation, FIG. 3 a partial longitudinal section through the "pistol".

The shown portable fire extinguisher comprises a cylindrical low-pressure tank 1 at the bottom of which a discharge tube 2 is attached near support legs 3 and at the opposite end of which a safety valve 4 is inserted near a screw socket 5. By means of a union nut 6 a cylindrical unit 7 is fastened to screw socket 5, with union nut 6 pressure a collar 8 against the face of screw socket 5. An O-ring 9 seals the gap between unit 7 and the inner surface of screw socket 5, which is integral with the low-pressure tank 1.

Cylindrical unit 7 has at its upper end a bell-shaped receptacle 10 provided with collar 8. At its outer end, a carrying handle 11 is hinged to bell-shaped receptacle 10. In the neck of bell-shaped receptacle 10 there is received a cylindrical section 12 of a pressure reducing valve 13 which can slide along its axis, being sealed by an O-ring 14 inserted in a groove. At the outer end of pressure reducing valve 13 a striker knob 15 is attached and is held in a position by a safety strip 16, where pressure reducing valve 13 is at its outer end position.

The inner end of pressure reducing valve 13 has a cylindrical section 17 running in an axial hole 19 of a guiding holder 20 and sealed by an O-ring 18. Holder 20 is sealed by O-rings and fastened by one screw each near the inner end of bell-shaped receptacle 10 and near the abutting end of a cylinder 21. Holder 20 is fitted with a pierced neck 22 onto which a propellant gas cartridge 23 designed as a high-pressure tank is screwed. Within hole 19 a sealing nipple 24 is provided, in which the hole piercing neck 22 ends. Sealing nipple 24 is fitted with a break-off lug 25, which is arranged at a short distance opposite the face of cylindrical end 17 of pressure reducing valve 13.

A number of axial holes 26 running the length of holder 20 connect the area between bell-shaped receptable 10 and pressure reducing valve 13 with the space inside cylinder 21 which houses the propellant gas cartridge 23, whose surface is at a short distance from the inside surface of cylinder 21.

Adjacent to the bottom end of propellant gas cartridge 23 cylinder 21 merges with a cylinder 27, along the axis of which a piston 28 and a piston 29, each sealed by an O-ring can slide. In the inoperative position of all parts shown in FIG. 1, piston 28 is near the bottom end of propellant gas cartridge 23, and piston 29 is at a distance from piston 28, thus forming a chamber 30 between the two pistons that is enclosed by the wall of cylinder 27, and in which the present solution (foaming agent) is located. On the side of piston 29 facing away from propellant gas cartridge 23 transfer apertures 31 are formed in a ring in the wall of cylinder 27, which provide a connection between the cylinder with an open bottom 27 and the interior of low-pressure tank 1. Near the end of cylinder 27 a transverse pin 32 is inserted, which forms a stop for piston 29. The depth of the two pistons 28 and 29 and the distance between transverse pin 32 and transfer apertures 31 are so dimensioned that when piston 29 is in contact with transverse pin 32 and piston 28 is in contact with piston 29, the transfer apertures 31 form an open passage from the interior of cylinder 27 or 21 to the interior of low-pressure tank 1.

In order to ready the apparatus for use from the inoperative or storage position shown in FIG. 1, all that needs to be done is to tear off safety strip 16 after removing a lead seal not shown, and to move pressure reducing valve 13 inwards by a blow on striker knob 15, which causes cylindrical end 17 of the valve to break off lug 25 of sealing nipple 24. This causes propellant gas (preferably carbon dioxide), which is stored in propellant gas cartridge 23 under a pressure of, for example, 60 to 70 bar to flow into hole 19. From here, it passes in a manner that is not shown through cylindrical end 17 into pressure reducing valve 13 which lets the gaseous carbon dioxide flow at a pressure of about 6 bar into the space enclosed by bell-shaped receptacle 10. The pressure reducing valve, which functions in the known manner, closes as soon as the pressure in bell-shaped receptacle 10 exceeds 6 bar. The carbon dioxide, expanded to a pressure of 6 bar, passes through axial holes 26 into cylinder 21, flows past propellant gas cartridge 23 and exerts pressure on piston 28. Thereupon piston 28 slides downwards, together with piston 29, until piston 29 comes into contact with transverse pin 32. As soon as piston 29 has passed by transfer apertures 31, the parent solution located in chamber 30 between the two pistons 28 and 29 flows out of it at the same time and mixes turbulently with the fire-inhibiting liquid, which surrounds cylinder 21 and cylinder 27, filling most of the interior of low-pressure tank 1. This mixing process ends when piston 28 reaches the lowest of holes 31. Now the apparatus is ready for use. This ready state is indicated by a pressure indicator 33 comprising a small piston 34 that is preloaded by a spring 35 and on whose sealed end leading to the outside an indicator button 36 is provided, and which can be seen and felt to protrude when the pressure in low-pressure tank 1 is large enough for the force acting on piston 34 to exceed the force of spring 35. In a preferred design, spring 35 produces an indication even at a pressure of less than 1 bar.

The preferred setting of safety valve 4 is at about 15 bar, thus preventing danger to the low-pressure tank 1 in case pressure reducing valve 13 fails. The proof pressure of low-pressure tank 1 is higher than the pick-up pressure of the safety valve, and should preferably be 25 bar. The term low-pressure tank refers to tanks whose bursting pressure is less than 100 bar, while tanks whose bursting pressure is more than 100 bar are designated high-pressure tanks (propellant gas cartridge 23). For example, the preferred proof pressure of propellant gas cartridge 23 amounts to 250 bar.

An automatic shut-off, rapid-action hose coupling 37 is attached to the end of discharge tube 2, to which coupling a spray gun 39 can be connected via a hose 38. Fire-inhibiting liquid 40 mixed with parent solution is sprayed onto the fire by means of spray gun 39.

Feeder hose 38 is connected tightly to a union nozzle 42 by means of a union nut 41. Union nozzle 42 is at the end of a tube 43 onto whose front end opposite to union nozzle 42 is screwed a spray nozzle 44. In addition, a pistol grip 45 is attached at an oblique angle to the tube and connected by a bridging piece 46 to another grip 47, which is parallel to pistol grip 45 and fastened to tube 43 near the front end. A triggering lever 48 is mounted on a pivot at a distance from and roughly parallel to pistol grip 45 between grips 45 and 47, which when pulled towards pistol grip 45 acts on a lever 49 which moves a needle valve 50 in the open direction against the action of a compression spring 51. Valve needle 50 is mounted so that it slides axially and is sealed in a hub piece 53 which is centered by radially arranged bracing pieces 52. The valve needle runs the length of tube 43, and over most of its length it is surrounded by straightening vanes 54 which straighten the flow through tube 43. At the front end of straightening vanes 54 which abut on spray nozzle 44 there is a hole 55 which tapers slightly in the direction of flow, merging with a very small radiused conical transition section 56 against which the front end of needle valve 50 seats tightly in the normally closed position. Conical section 56 merges into a short cylindrical section 57 defining the throat section, which in turn expands abruptly to a larger diameter 58 just before the face of spray nozzle 44.

If triggering lever 48 is actuated, that is to say pivoted in the direction of grip 45, then it causes lever 49 to pivot, which lifts valve needle 50 from the valve seat, namely tapered section 56 so that the liquid under pressure can flow from low-pressure tank 1 by way of discharge tube 2 and hose 38 into tube 43. The fire-inhibiting liquid then flows past straightening vanes 54, which ensures smooth flow. At tapered hole 55 the speed of flow increases, reaching its maximum in cylindrical section 57. By this arrangement in conjunction with the preset constant pressure of about 5 to 6 bar, a cast of the jet of up to more than 20 meters can be achieved, without the jet breaking up into individual droplets too much. This makes it possible to fight fires from a safe distance. The provision of the two grips 45 and 47 allows convenient handling and, in particular, a precise aiming.

Figure 2:
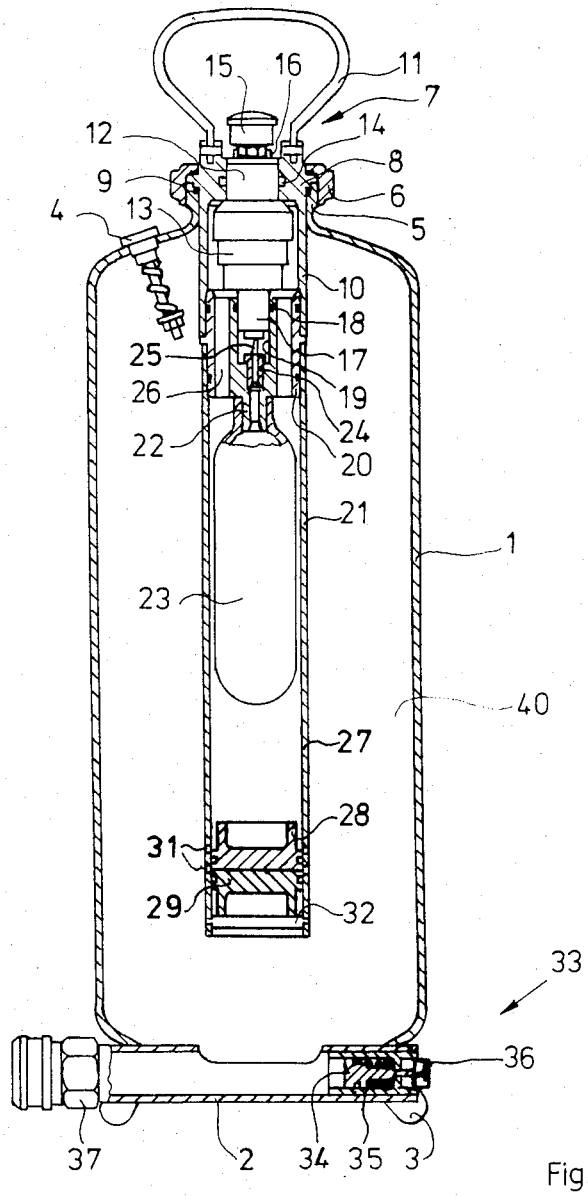
Figure 3:
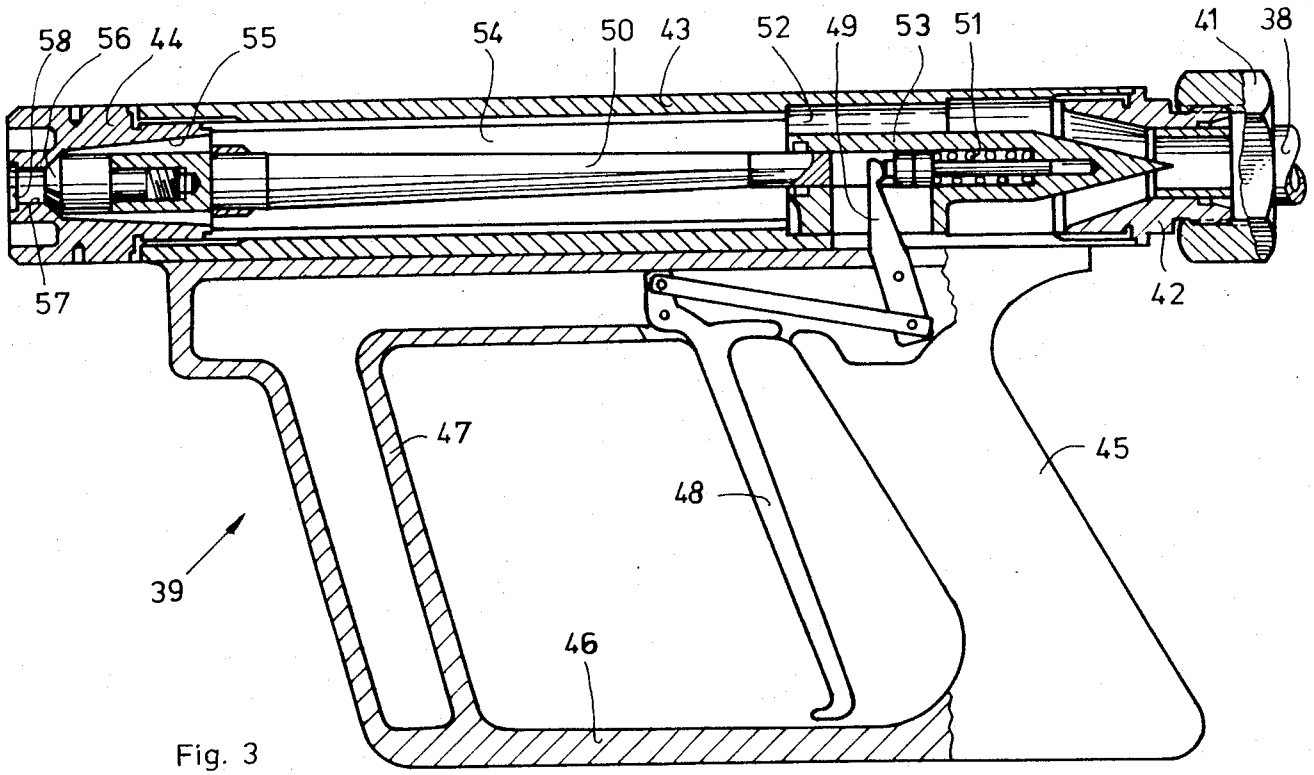
Figure 4:
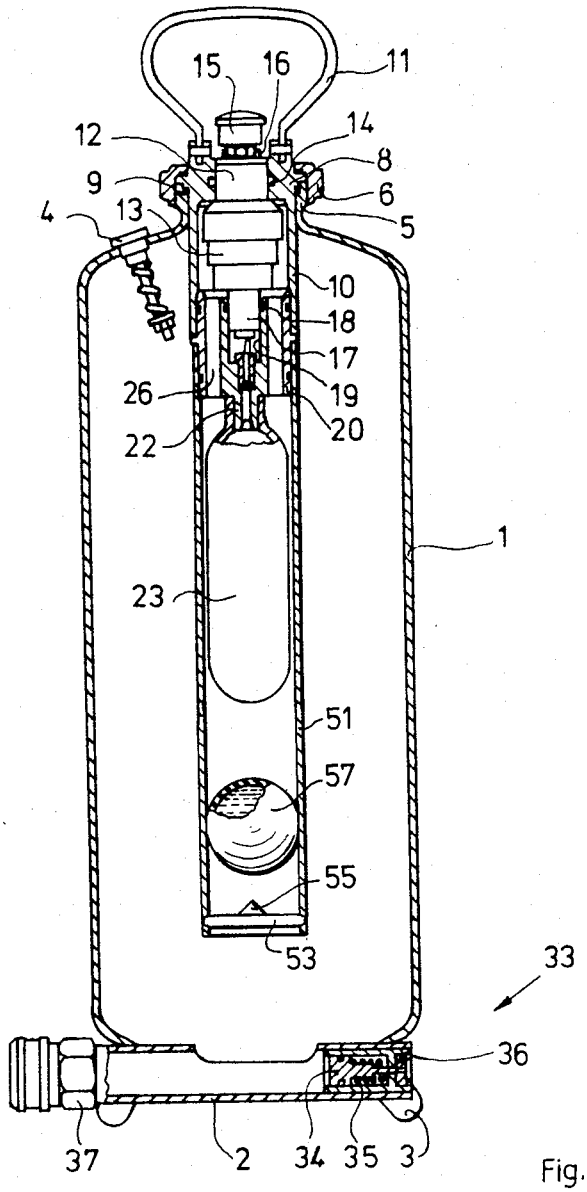
FIG. 4 is a longtiduinal section through an apparatus for dispensing a liquid, partly broken away, the individual parts being in the inoperative position.
Figure 5:
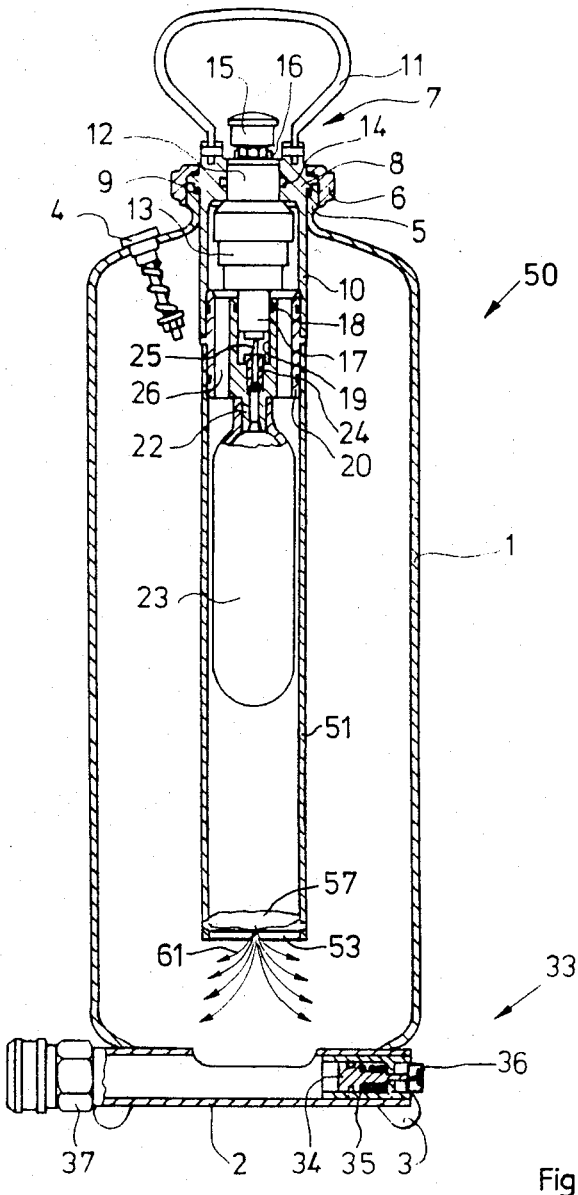
FIG. 5 is the apparatus in accordance with FIG. 4 after actuation.

The apparatus 50 shown in FIGS. 4 and 5 is used together with the "pistol" shown in FIG. 3, and differs from the arrangement shown in FIGS. 1 and 2 only with respect to the following items:

The cylinder 51, contrary to the cylinder 21, does not have transfer apertures 31 in its wall, but carries at its lowermost end, instead of the transverse pin 32, a transverse pin 53 which carries a spike or a penetrating member 55 which is arranged inside the cylinder 51 and looks upwards. Also the pistons 28 and 29 of the apparatus of FIGS. 1 and 2 are not provided in the apparatus 50, but in the space between the propellant gas cartridge 23 and the spike 55, a hollow ball 57 of rubber is provided which in FIG. 4 is arranged in a distance from the spike 55. The diameter of the ball 57, prior to insertion into the cylinder 51 is somewhat greater than the inner diameter of the cylinder 51, so that those parts of the ball 57 which are in contact with the inner wall of the cylinder 51 lie against the inner wall under a sufficiently high pressure such that because of the frictional forces between the inner side of the wall of the cylinder 51 and the ball 57 the latter cannot move notwithstanding vibration or the face of gravity on it. The low pressure tank 1 contains water to which an antifreezing agent is added. The ball 57 contains a tear gas concentrate. If the striker knob 15 is actuated by the user and, as described with respect to FIGS. 1 and 2 above, the propellant gas coming out from the propellant gas cartridge 23 comes into the space below the propellant gas cartridge, the propellant gas will displace the ball 57 in downward direction, till the ball comes in contact with the spike 55. This dislocation of the ball 57 is possible since the ball is in tight contact with the wall of the cylinder 51 and therefore, the propellant gas is not allowed to escape between the cylinder 51 and theball 57. As the ball 57 is moved further in a downward direction, the spike 57 will penetrate the wall of the bal 57, thus opening and destroying the container formed by the ball 57. Since the propellant gas will continue to exert a pressure onto the ball 57 from above, the fluid (tear gas concentrate) within the ball 57 will be expelled from the ball. Consequently, as indicated by arrows 61 in FIG. 5, the concentrate mixed with the first liquid, namely the water. Since the ball 57, when empty, no longer lies against the cylinder 52 in a tight relationship, the propellant gas is allowed to pass about the back and through the lowermost end of the cylinder 1 into the low pressure tank 1. The first liquid contained in the low pressure tank 1 will be expelled through the discharge tube 2 and through the spray gun 39 (FIG. 3), which is to be connected to the apparatus 50, exactly in the same manner as described with respect to FIGS. 1 through 3.

It is possible to produce the ball 57 from another plastic material instead of rubber. In the example described, the wall of the ball 57 has a thickness of 1 mm.

Instead of the ball 57 there might be arranged another cylinder within this cylinder 51, the further cylinder comprising a rigid cylindrical wall which, is closed on its lower and upper ends by destroyable walls, preferably by membranes made of rubber or a suitable plastic material. This further cylinder carries on its exterior two sealing ring washers having a circular cross-section (O-ring) which provides for the frictional forces mentioned above and for the sealing function between the inner wall surface of the cylinder 51 and this further cylinder, such that the further cylinder does not move due to vibrations. If the propellant gas is released from the propellant gas cartridge, the further cylinder is moved in a downward direction, the membrane at its lower side is destroyed by the spike 55. Now, the propellant gas presses onto the upper side membrane of the further cylinder, deforming this upper membrane and thus expelling the further fluid out of the further cylinder. Finally, the upper membrane is destroyed under the pressure of the propellant gas, the propellant gas will expell the rest of the further fluid contained in the further cylinder, and finally will come into the low pressure tank.

In the ball 57 of the apparatus 50, instead of the tear gas concentrate there may be contained another liquid or fluid suitable for a special application. This further fluid or liquid may also be the parent solution (foaming agent) described in connection with the fire extinguisher of FIGS. 1 to 3. In this latter case, the apparatus 50 will then be a fire extinguisher.

An advantage of the embodiment of FIGS. 4 and 5 and the modifications therefrom is the fact that the ball 57 or the mentioned further cylinder after having been filled with the further fluid and after having been closed may be handled and inserted into the cylinder 51 without difficulty.

It is apparent that this invention is not restricted to the embodiments shown; rather, further deviations from them are possible without departing from the scope of the invention. In particular, individual characteristics of the invention may be used alone or in combinations of several of them.

I claim:

1. A fire extinguisher comprising a first tank for storage of a fire inhibiting liquid under low pressure and having an outlet for dispensing the same, a cylindrical housing supported within said first tank, a second tank for storage of a propellant gas under high pressure, said second tank being located within said first tank and being provided with a pressure reducing valve having an outlet for discharging said propellant gas into said first tank to maintain the low pressure therein, said second tank and said reducing valve being aligned axially and located in said cylindrical housing, a means for storing a parent solution for foaming said fire-inhibiting liquid, said storing means being located within said first tank and having one end communicating with the discharge of said reducing valve and having means for expelling said parent solution from said cylindrical housing on discharge of said propellant gas into said first tank.

2. The fire extinguisher according to claim 1 wherein the storage means for said parent solution comprising a cylinder having one end communicating with the discharge from said reducing valve, said one end comprising a first piston movable by the reduced pressure of the propellant gas to expel said parent solution.

3. The fire extinguisher according to claim 2 wherein the cylinder is provided with at least one orifice in its wall, and the other end of said cylinder comprises a second piston, normally positioned to occlude passage of said parent solution through said orifice, said second piston being slidable on movement of said first piston to permit passage of said parent solution through said orifice.

4. The extinguiser according to claim 3 wherein said cylindrical storage means is axially aligned with said cylindrical housing and integrally connected to it.

5. The fire extinguisher according to claim 4 wherein said cylindrical housing is threadably attached into the wall of said first tank.

6. The fire extinguisher according to claim 4 wherein the outlet of said second tank is normally closed by a frangible sealing nipple interposed adjacent said reducing valve said reducing valve being slidably mounted within said cylindrial housing and accessible from the exterior of said extinguisher, said reducing valve being movable to break said sealing nipple.

7. The fire extinguisher according to claim 3 including a nozzle adapted to be attached to the outlet of said first tank.

8. The fire extinguisher according to claim 7 wherein said nozzle includes vanes for straightening the flow of liquid issued therefrom.

9. The fire extinguisher according to claim 7 wherein said nozzle comprises a manually held body in the form of a pistol having a hollow barrel and a first hand grip, an outlet at the forward end of said barrel and means at the rear end of said barrel for connecting a conduit thereto, a needle valve located in said barrel and actuating means including a trigger lever operable in conjunction with said hand grip for selectively operating said needle valve to permit flow of liquid through said barrel, and vanes extending substantially the length of said barrel for straightening the flow of liquid thereto.

10. The nozzle according to claim 9 including a second hand grip, substantially parallel to said first hand grip, extending from said barrel forward of said first hand grip.

11. Apparatus for liquid spraying comprising a first tank for storage of a first liquid under low pressure and having an outlet for dispensing the same, a cylindrical housing supported within said first tank, a second tank for storage of a propellant gas under high pressure, said second tank being located within said first tank and being provided with a pressure reducing valve having an oulet for discharging said propellant gas into said first tank to maintain the low pressure therein, said second tank and said reducing valve being aligned axially and located in said cylindrical housing, means for storing a second liquid for mixture with said first liquid, said storing means being located within said first tank and having one end communicating with the discharge of said reducing valve and having means for expelling said second liquid from said cylindrical housing on discharge of said propellant gas into said first tank.

12. The apparatus according to claim 11 wherein the storage means for said second liquid comprises a cylinder having one end communicating with the discharge from said reducing valve, said one end comprising a first piston movable by the reduced pressure of the propellant gas to expel said second liquid.

13. The apparatus according to claim 12 wherein the cylindrical storage means is provided with at least one orifice in its wall, and the other end of said cylindrical storage means comprises a second piston, normally positioned to occlude passage of said second liquid through said orifice, said second piston being slidable on movement of said first piston to permit passage of said second liquid through said orifice.

14. The apparatus according to claim 13 wherein said cylindrical storage means is axially aligned with said cylindrical housing and integrally connected to it.

15. The apparatus according to claim 14 wherein said cylindrical housing is threadably attached into the wall of said first tank.

16. The apparatus according to claim 15 wherein the outlet of said second tank is normally closed by a frangible sealing nipple interposed adjacent said reducing valve said reducing valve being slidably mounted within said cylindrical housing and accessible from the exterior of said extinguisher, said reducing valve being movable to break said sealing nipple.

17. The apparatus according to claim 13 including a nozzle adapted to be attached to the outlet of said first tank.

18. The apparatus according to claim 17 wherein said nozzle includes vanes for straightening the flow of liquid issued therefrom.

19. The apparatus according to claim 17 wherein said nozzle includes a manually held body in the form of a pistol having a hollow barrel and a first hand grip, an oulet at the forward end of said barrel and means at the rear end of said barrel for connecting a conduit thereto, a needle valve located in said barrel and actuating means including a trigger lever operable in conjunction with said hand grip for selectively operating said needle valve to permit flow of liquid through said barrel, and vanes extending substantially the length of said barrel for straightening the flow of liquid thereto.

20. The nozzle according to claim 19 including a second hand grip, substantially parallel to said first hand grip, extending from said barrel forward of said first hand grip.

21. The apparatus according to claim 11, wherein the storage means for said second liquid comprises a cylinder one end of which faces the pressure reducing valve, and the other end of which faces away from the pressure reducing valve, said other end having at least one transfer aperture for the passage of the second liquid into the low pressure tank, said cylindrical housing having a penetrating member mounted such that by the reduced pressure of the propellant gas a part of the wall of the cylindrical storage means is pressed against the penetrating member and the cylindrical storage means is ruptured, releasing the second liquid into the low-pressure tank for mixture with the first liquid.

22. The apparatus according to claim 21, wherein the cylindrical storage means is arranged in the cylindrical housing, such that the cylindrical storage means is slidable under the influence of the reduced pressure of the propellant gas.

23. The apparatus according to claim 22, wherein the cylindrcal storage means is formed of plastic or rubber material.

24. The apparatus according to claim 23, wherein the penetrating member is a needle.

25. The apparatus according to claim 11, wherein the storage means for said second liquid comprises a hollow ball and a penetrating member is mounted in the cylindrical housing such that by the reduced pressure of the propellant gas ball is pressed against the penetrating member and the storage means is destroyed, thus releasing the second liquid into the low-pressure tank for mixture with the first liquid.

26. The apparatus according to claim 25, wherein the ball is arranged in the cylindrical housing, such that the ball is slidable under the influence of the reduced pressure of the propellant gas.

27. The apparatus according to claim 26, wherein the ball is formed of plastic or rubber material.

28. The apparatus according to claim 27, wherein the penetrating member is a needle.

* * * * *